US006652060B2

(12) United States Patent
Uchida

(10) Patent No.: US 6,652,060 B2
(45) Date of Patent: Nov. 25, 2003

(54) IMAGE RECORDING APPARATUS, IMAGE RECORDING METHOD, STORAGE MEDIUM WHICH STORES COMPUTER-READABLE PROGRAM AND THE SAME PROGRAM

(75) Inventor: Kota Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/901,041

(22) Filed: Jul. 10, 2001

(65) Prior Publication Data

US 2002/0024574 A1 Feb. 28, 2002

(30) Foreign Application Priority Data

Jul. 12, 2000 (JP) ..... 2000-211211
May 28, 2001 (JP) ..... 2001-158532

(51) Int. Cl.[7] ..... B41J 29/38
(52) U.S. Cl. ..... 347/16; 399/82
(58) Field of Search ..... 347/14, 16, 19, 347/104; 355/24, 26; 399/82, 364, 401; 358/1.18

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 4,780,745 | A | * | 10/1988 | Kodama | 399/401 |
| 4,990,941 | A | * | 2/1991 | Kawai | 355/319 |
| 5,214,442 | A | * | 5/1993 | Roller | 347/16 |
| 5,581,339 | A | * | 12/1996 | Jamzadeh et al. | 355/282 |
| 5,708,919 | A | * | 1/1998 | Yamada et al. | 399/67 |
| 5,714,990 | A | * | 2/1998 | Courtney | 347/14 |
| 6,012,809 | A | * | 1/2000 | Ikeda et al. | 347/101 |
| 6,015,201 | A | * | 1/2000 | Asakura | 347/19 |
| 6,149,327 | A | * | 11/2000 | Ward et al. | 400/582 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 6-134982 | 5/1994 |

OTHER PUBLICATIONS

Frank Cost, Pocket Guide to Digital Printing, 1997, Thomson Learning, Chapter 5, pp. 79–110.*

* cited by examiner

*Primary Examiner*—Judy Nguyen
*Assistant Examiner*—Blaise Mouttet
(74) *Attorney, Agent, or Firm*—Fitzpatrick, Cella, Harper & Scinto

(57) ABSTRACT

An image recording apparatus and an image recording method utilize a setting unit variably setting a length of time between an end of recording on a first recording side (surface) of a recording medium and a start of recording on a second recording side (reverse side) of the recording medium in accordance with image data for recording on the first recoding side of the recording medium.

6 Claims, 9 Drawing Sheets

FIG. 9

| APPLICATION AMOUNT OF INK (M) | LENGTH OF TIME (T) |
|---|---|
| $0 \leqq M < m1$ | $T = t1$ |
| $m1 \leqq M < m2$ | $T = t2$ |
| $m2 \leqq M < m3$ | $T = t3$ |
| $m3 \leqq M$ | $T = t4$ |

FIG. 11

| RECORDING MEDIUM | APPLICATION AMOUNT OF INK | LENGTH OF TIME |
|---|---|---|
| PLAIN PAPER | $0 \leqq M < m1$ | $T = ta1$ |
| | $m1 \leqq M < m2$ | $T = ta2$ |
| | $m2 \leqq M < m3$ | $T = ta3$ |
| | $m3 \leqq M$ | $T = ta4$ |
| COATED PAPER | $0 \leqq M < m1$ | $T = tb1$ |
| | $m1 \leqq M < m2$ | $T = tb2$ |
| | $m2 \leqq M < m3$ | $T = tb3$ |
| | $m3 \leqq M$ | $T = tb4$ |
| GLOSSY PAPER | $0 \leqq M < m1$ | $T = tc1$ |
| | $m1 \leqq M < m2$ | $T = tc2$ |
| | $m2 \leqq M < m3$ | $T = tc3$ |
| | $m3 \leqq M$ | $T = tc4$ |

IMAGE RECORDING APPARATUS, IMAGE RECORDING METHOD, STORAGE MEDIUM WHICH STORES COMPUTER-READABLE PROGRAM AND THE SAME PROGRAM

BACKGROUND OF THE INVENTION

1. Field of the Invention

The present invention relates to an image recording apparatus and an image recording method for recording an image by applying a coloring material on a recording medium in accordance with image data, and more particularly to an image recording apparatus and an image recording method which permit recording on both sides of the recording medium.

2. Related Background Art

With widespread use of a copier, an information processing apparatus such as a word processor or computer and a communication apparatus, an inkjet recording apparatus for recording a digital image by an inkjet method has rapidly come into wide use as one of output apparatuses for image forming (recording) of the above apparatuses. In the recording apparatus of this type, in order to improve a recording speed, a recording head which has integrated ink discharge ports and liquid paths is used as a recording head which has a plurality of ink discharge nozzles arranged integratedly, and recently, with the progress of color supporting, many of the apparatuses have been equipped with more than one recording head as above described together.

In an inkjet recording method, the recording is executed by applying ink as recording liquid, in the form of a spattering (or flying) droplet applied to a recording medium such as paper, and the method makes little noise because it is a non-contact method. Further, high concentration of the ink discharge nozzles can cause realization of high resolution and high speed recording, and moreover, no particular processing such as developing or fixing is required to be effected on a recording medium such as plain paper, and an image of high quality can be obtained at low cost, so that a range of uses of the method has been increased in recent years. Especially, an inkjet recording apparatus of an on-demand type is considered to have a potential for future demand since the apparatus is easily made to be color supporting and can be also miniaturized and simplified in itself. The variety of uses by users has also increased, which has accompanied various types of apparatuses coming into practical use. As an example, there is a recording apparatus including a both-side recording mechanism which permits recording on both sides of a recording medium.

In the recording apparatus including such a both-side recording mechanism, generally, ink is first applied on a surface (first recording side) of the recording medium to carry out recording on the surface, and then the recording medium is reversed to carry out recording on a reverse side (second recording side). At this time, if recording is carried out on a recording medium with relatively poor permeability of ink, the ink is not immediately permeated and it sometimes takes much time for the ink on the medium surface to be sufficiently dried (or fixed). When carrying out recording on the recording medium with such relatively poor fixing of the ink, it is necessary to set time between recording on the surface and recording on the reverse side relatively long. It is because, if the recording medium is to be reversed to start recording on the reverse side immediately after recording on the surface, the ink on the surface which is not sufficiently dried (or fixed) is made contact with a conveying path due to the above described reversing, and the ink on the surface and the conveying path are rubbed against each other to cause an ink stain. Accordingly, it is preferable to set a length of time between an end of surface recording and a start of reverse side recording such that the ink on the medium surface is sufficiently dried to cause no ink stain even if the recording medium is reversed. For example, in Japanese Patent Laid-Open No. 6-134982, a length of time between an end of surface recording and a start of reverse side recording is determined in accordance with a kind of a recording medium. According to the Japanese Patent Laid-Open No. 6-134982, a length of time is set relatively short in case of recording on a recording medium which ink permeates relatively quickly and on which the ink is well fixed, while the length of time is set relatively long in case of recording on a recording medium which the ink permeates relatively slowly and on which the ink is poorly fixed, thereby preventing an ink stain.

However, in the Japanese Patent Laid-Open No. 6-134982, the length of time between the end of surface recording and the start of reverse side recording is set in consideration of only the kind of the recording medium, so that the lengths of time are identically set even in case of recording on the same recording media in different printing duties. That is, the same length of time is required in either case of a high printing duty or a low printing duty. The inventor has found that, though acceptable in the case of the high printing duty, a time longer than needed is set in the case of the low printing duty, which causes a waste of time. That is, in the case of the low printing duty, the ink is fixed more quickly than in the case of the high printing duty, so that occurrence of an ink stain can be sufficiently restrained even if the time is set short.

As described above, conventionally, reduction of printing time in the case of the low duty has not been sufficiently achieved due to identically setting the time between the end of surface recording and the start of reverse side recording regardless of the printing duty. Under the present circumstances where high speed and high quality are required more and more, it is desirable to eliminate a waste of time to achieve reduction of printing time and to sufficiently restrain occurrence of an ink stain.

SUMMARY OF THE INVENTION

The present invention is achieved in view of the above problems and has its object to provide an image recording apparatus, an image recording method, a storage medium which stores a computer-readable program and the program, which can restrain occurrence of an ink stain and achieve reduction of time for printing in the case of both-side recording.

In order to achieve the above object, the present invention provides an image recording apparatus for recording an image by applying a coloring material on a recording medium in accordance with image data by recording means, including: conveying means for conveying the recording medium so as to permit recording on both of a first recording side and a second recording side of the recording medium; setting means for variably setting a length of time between an end of recording on the first recording side of the recording medium and a start of recording on the second recording side of the recording medium in accordance with the image data for recording on the first recording side of the recording medium; and control means for controlling conveying operation by the conveying means such that recording on the second recording side of the recording medium by the recording means is started after passage of time set by the setting means.

The present invention further provides an image recording apparatus for recording an image by applying a coloring material on a recording medium in accordance with image data by recording means, including: conveying means for conveying the recording medium so as to permit recording on both of one recording side and the other recording side of the recording medium; determining means for determining on which recording side of one recording side or the other recording side of the recording medium, recording is previously carried out, based on both of image data for recording on one recording side of the recording medium and image data for recording on the other side of the recording medium; setting means for variably setting a length of time between an end of recording on one recording side of the recording medium and a start of recording on the other recording side of the recording medium in accordance with the image data for recording on the recording side which is determined by the determining means; and control means for controlling conveying operation by the conveying means such that recording on the other recording side by the recording means is started after passage of time set by the setting means.

The present invention further provides an image recording method for recording an image by applying a coloring material on a recording medium in accordance with image data by recording means, including: a conveying process of conveying the recording medium so as to permit recording on both of a first recording side and a second recording side of the recording medium; a setting process of variably setting a length of time between an end of recording on the first recording side of the recording medium and a start of recording on the second recording side of the recording medium in accordance with the image data for recording on the first recording side of the recording medium; and a controlling process of controlling conveying operation of the recording medium such that recording on the second recording side of the recording medium by the recording means is started after passage of time set by the setting means.

The present invention further provides an image recording method for recording an image by applying a coloring material on a recording medium in accordance with image data by recording means, including: a conveying process of conveying the recording medium so as to permit recording on both of one recording side and the other recording side of the recording medium; a determining process of determining on which recording side of one recording side or the other recording side of the recording medium, recording is previously carried out, based on both of image data for recording on one recording side of the recording medium and image data for recording on the other side of the recording medium; a setting process of variably setting a length of time between an end of recording on one recording side of the recording medium and a start of recording on the other recording side of the recording medium in accordance with the image data for recording on the recording side which is determined by the determining process; and a controlling process of controlling conveying operation of the recording medium such that recording on the other recording side by the recording means is started after passage of time set by the setting process.

The present invention further provides a computer-readable storage medium which stores a program for executing a control processing of an image recording apparatus for recording an image by applying a coloring material on a recording medium in accordance with image data by recording means, wherein the program comprises: (a) a process of conveying the recording medium so as to permit recording on both of a first recording side and a second recording side of the recording medium; (b) a process of variably setting a length of time between an end of recording on the first recording side of the recording medium and a start of recording on the second recording side of the recording medium in accordance with the image data for recording on the first recording side of the recording medium; and (c) a process of controlling conveyance of the recording medium such that recording on the second recording side of the recording medium by the recording means is started after passage of time set by the setting process.

The present invention further provides a program for executing a control processing of an image recording apparatus for recording an image by applying a coloring material on a recording medium in accordance with image data by recording means, comprising: (a) a process of conveying the recording medium so as to permit recording on both of a first recording side and a second recording side of the recording medium; (b) a process of variably setting a length of time between an end of recording on the first recording side of the recording medium and a start of recording on the second recording side of the recording medium in accordance with the image data for recording on the first recording side of the recording medium; and (c) a process of controlling conveyance of the recording medium such that recording on the second recording side of the recording medium by the recording means is started after passage of time set by the setting means.

By providing a first configuration wherein time (waiting time) between an end of surface recording and a start of reverse side (second recording side) recording is variably set based on image data on the surface (first recording side), the waiting time is set short when a recording duty of the surface is low, which permits sufficiently reducing an ink stain and also achieving reduction of total recording time in both-side recording.

Further, by providing a second configuration wherein recording is started on either of the surface (first recording side) or the reverse side (second recording side) which has a lower recording duty, and wherein based on the recording data on the previous recording side, waiting time between an end of recording on the previous recording side and a start of recording on the reverse side is variably set, the waiting time can be reduced more than in the case of the above described first configuration, which results in realizing further reduction of recording time in both-side recording.

BRIEF DESCRIPTION OF THE DRAWINGS

FIG. 9 is a table showing a relationship between ranges of application amounts of ink (M) and lengths of time (T) between an end of surface recording and a start of reverse side recording;

FIG. 11 is a table showing relationship among kinds of recording media, ranges of application amounts of ink (M) and lengths of time (T) between an end of surface recording and a start of reverse side recording.

DESCRIPTION OF THE PREFERRED EMBODIMENTS

Embodiments of the present invention will be described below with reference to the drawings.

First Embodiment

Figure 1:
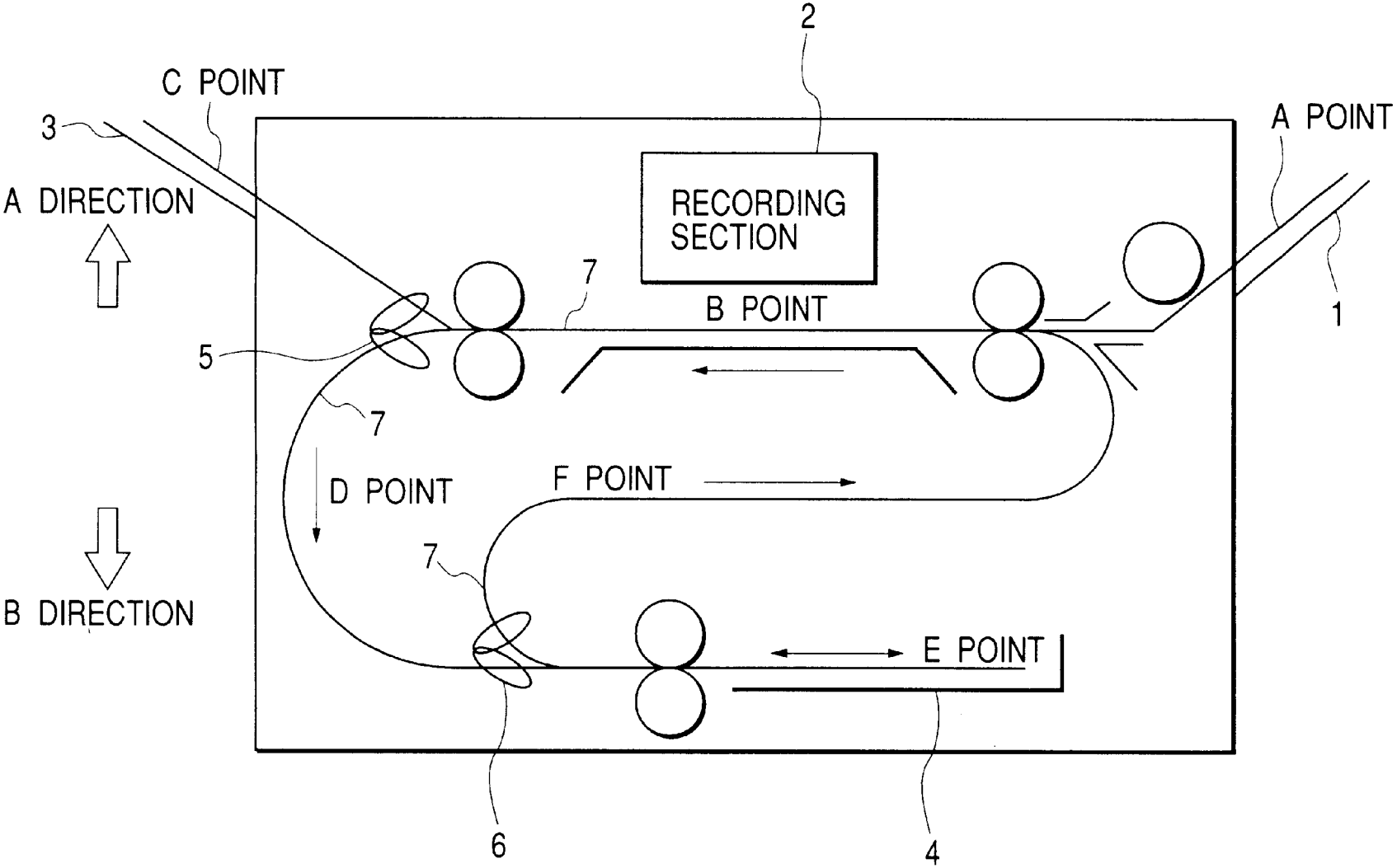
FIG. 1 is a schematic view of a configuration of an example of a recording apparatus which can be applied to the present invention.

FIG. 1 is a schematic view of a configuration of an example of an image recording apparatus which can be applied to the present invention and which is provided with a both-side recording mechanism (both-side printing function) for permitting recording on both sides of a recording medium by reversing the recording medium. In FIG. 1, reference numeral 1 denotes a paper feed tray (paper feed section); 2, a recording section (recording means); 3, a paper output tray (paper output section); 4, a both-side tray; 5 and 6, change-over sections; and 7, a conveying path. Located on the paper feed tray 1 are the recording media, which are fed one by one. On the fed recording medium, an image is formed (recorded) by the recording section 2 and output to the paper output tray 3 as it is in the case of one-side recording. In the case of both-side recording, the change-over section 5 is pivoted upward in the figure (substantially in the same direction as an A direction in FIG. 1) to switch the conveying path 7, and the recording medium with recording on one side by the recording section 2 is conveyed to the both-side tray 4 to be temporarily stored.

A length of time between an end of recording on a surface (first recording side) of the recording medium and a start of recording on a reverse side (second recording side) is determined (set) in accordance with an image data on the surface. That is, a length of time required for sufficient fixing (or drying) of ink is determined in consideration of the image data, and reverse side recording is adapted to be started after passage of the determined time. In this embodiment, the recording medium is in wait in the both-side tray 4 after the end of surface recording and before the start of reverse side recording. For this reason, the time between the end of surface recording and the start of reverse side recording is sometimes referred to as "waiting time" herein.

When recording on the reverse side, the change-over section 6 is pivoted downward in the figure (substantially in the same direction as a B direction in FIG. 1) to switch the conveying path and to feed the recording medium from the both-side tray 4. The recording medium is then conveyed to the recording section 2 through the conveying path at a point F. After that, recording on the reverse side is carried out in the recording section 2, and the recording medium with recording on the reverse side is output to the paper output tray 3 as it is. The recording medium output from the both-side tray 4 is conveyed to the recording section 2 through the point F in the figure, so that the surface and reverse side of the recording medium are changed when the recording medium reaches a position (point B) facing the recording section 2, which permits recording on the reverse side by the recording section 2. By a mechanism configured by the both-side tray 4, the change-over section 6 and the conveying path 7 including the point F, the recording medium is reversed to permit both-side recording, thus the mechanism is hereinafter referred to as a reversing mechanism (reversing means) or a both-side recording mechanism.

Here, conveying manners of the recording medium in the case of one-side recording and the case of both-side recording will be illustrated using reference characters A to F showing positions in FIG. 1. In one-side recording, the recording medium is conveyed in the order of A→B→C. In both-side recording, the recording medium is conveyed in the order of A→B→D→E→F→B→C.

Figure 2:
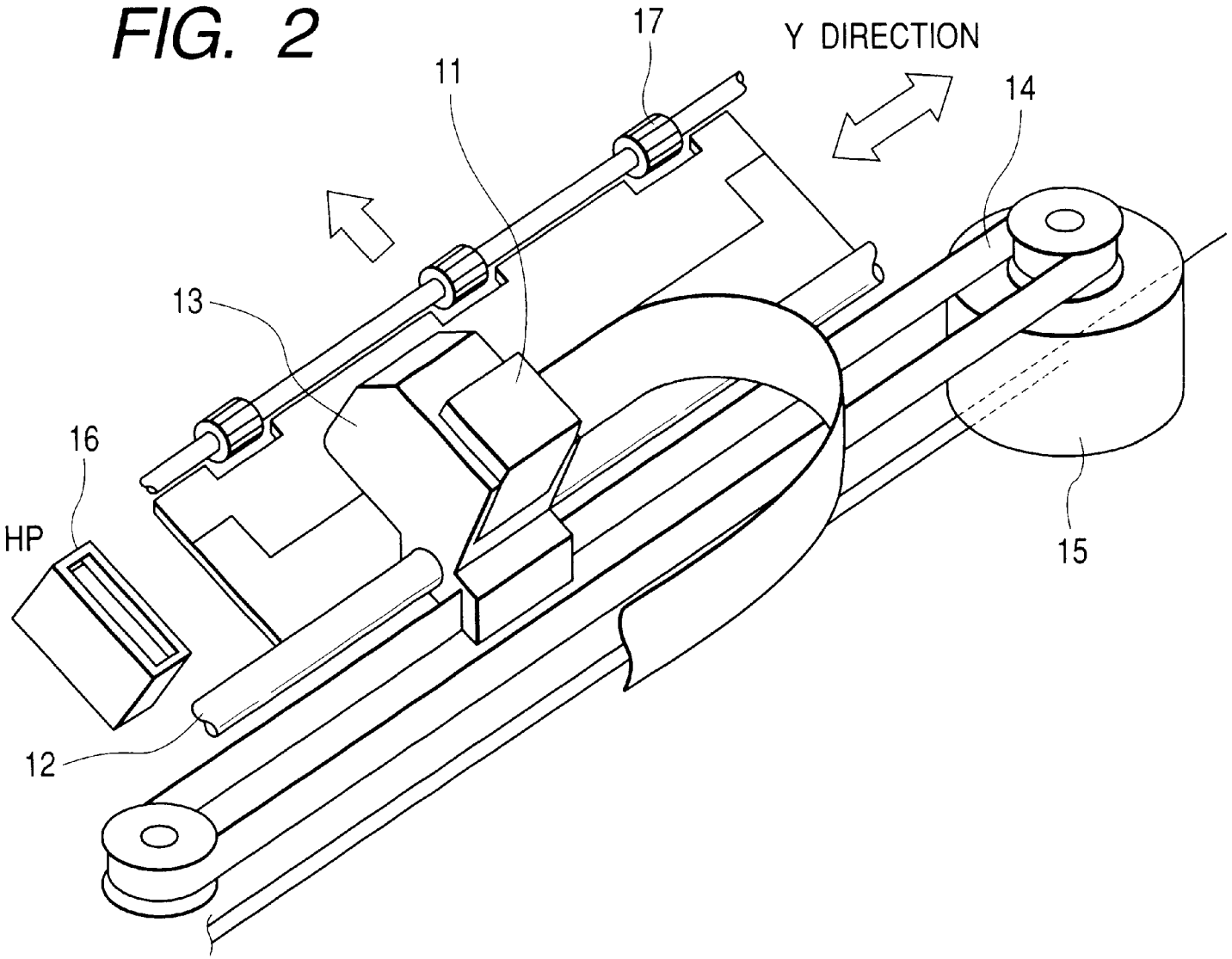
FIG. 2 is a perspective view of a peripheral configuration of a recording section 2 in the image recording apparatus in FIG. 1.

FIG. 2 is a perspective view of a peripheral configuration of the recording section 2 in the image recording apparatus in FIG. 1. A recording section (inkjet unit) 11 having a column (or row) of discharge ports for discharging ink is located on a carriage 13. The recording medium made of a plain paper or an OHP sheet is supported by a paper output roller 17 in a sandwiched manner through a conveying roller (not shown) and conveyed in an arrow direction by driving an unshown conveying motor. The carriage 13 is supported in a guided manner by a guide shaft 12 and an encoder (not shown). The carriage 13 is reciprocated along the guide shaft 12 by driving a carriage motor 15 via a driving belt 14. That is, the carriage is reciprocated in a Y direction in FIG. 2.

A heat-generating element (electrothermal energy transducing element) for generating thermal energy for discharging ink is provided inside (in a liquid path) of an ink discharge portion of an inkjet recording head (details thereof will be described below with reference to FIGS. 3 and 4) in the inkjet unit 11. In compliance with reading timing of the encoder (not shown), the heat-generating element is driven based on a recording signal to spatter and apply an ink droplet on the recording medium and to thereby form an image.

Arranged on a home position (HP) outside a recording area is a recovery unit having a cap 16. When recording is not carried out, the carriage 13 is moved to the home position (HP), and an ink discharge ports forming side of the inkjet recording head is closed by the cap 16 to prevent adhesion of the ink resulting from vaporization of an ink solvent or clogging by applied foreign matters such as dust or powdered paper.

The cap 16 having a capping function is used, in order to solve discharge failure or clogging due to increased thickness, adhesion, or the like of the ink at the ink discharge port with low recording frequency, as a position for carrying out a preliminary discharge mode wherein the ink is discharged to the cap 16 apart from the ink discharge port or as a position for carrying out a sucking operation mode wherein an unshown pump is operated with the cap on to suck the ink from the ink discharge port and to recover the ink discharge port with the discharge failure. Providing a blade in a position adjacent to the cap 16 permits cleaning the ink discharge ports forming side of the inkjet recording head.

Figure 3:
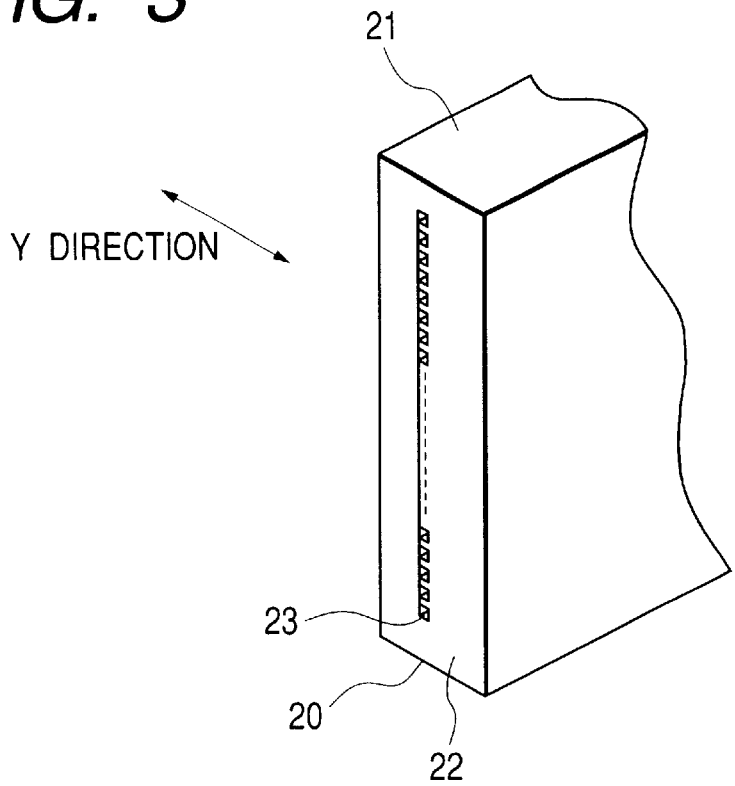
FIG. 3 is a typical perspective view of a column of ink discharge ports in an ink discharge portion of an inkjet recording head 21 seen from a recording medium side.
Figure 4:
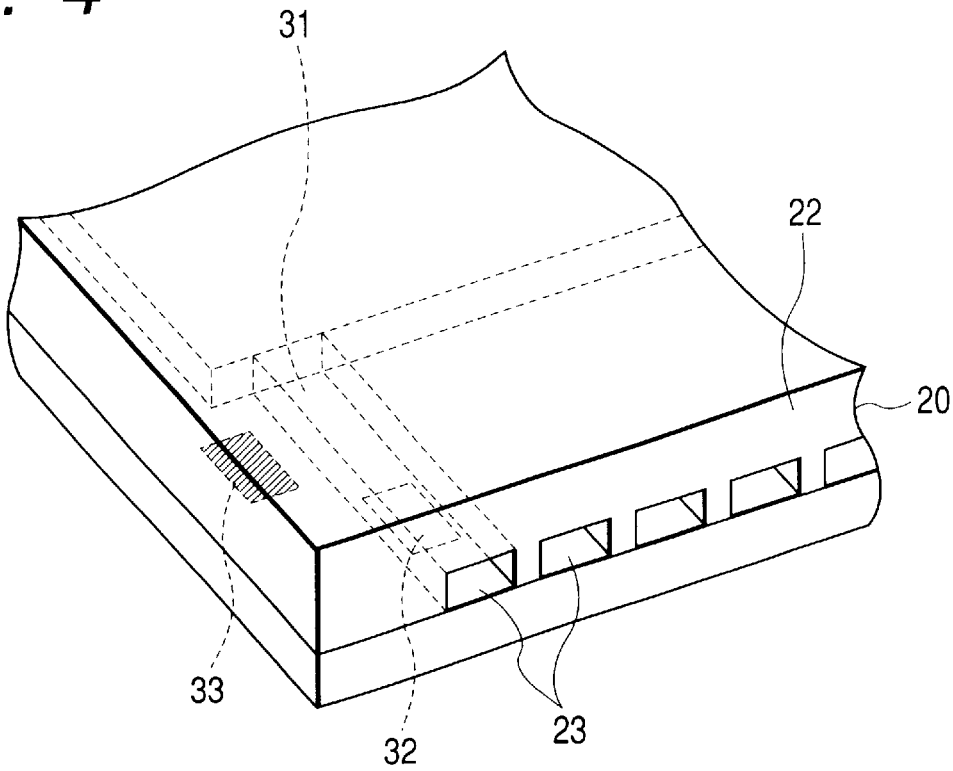
FIG. 4 is a typical perspective view of a part of inner structure of the ink discharge portion.

FIG. 3 is a typical perspective view of a column of the ink discharge ports in the ink discharge portion of an inkjet recording head 21 seen from the recording medium side, and FIG. 4 is a typical perspective view of a part of inner structure of the ink discharge portion. The ink discharge portion includes an ink discharge port side 22 having a plurality of ink discharge ports 23, and in liquid paths 31 communicating with the ink discharge ports 23, energy generating elements 32 for generating energy which is required for discharging the ink are respectively arranged. An arrow Y in FIG. 3 shows a scanning direction of the carriage 13. Reference numeral 33 in FIG. 4 denotes a sensor for detecting temperature of the recording head, and in this embodiment, thermistors 33 are provided on both ends of the column of the discharge ports. Temperature detecting means is not limited to this, but other sensor such as a diode sensor or the like may be used, and further, the temperature of the head may be calculated from a duty of printing dots.

As shown in FIG. 4, a recording method wherein the ink is discharged utilizing the thermal energy is used. However, the embodiment is not limited to this recording method. For example, a pressure control method for discharging an ink droplet from an orifice (discharge port) by mechanical vibration of a piezo-vibration element is applicable in an on-demand type, and a charge control method, a diffusion control method, or the like are applicable in a continuous type.

Next, a configuration of a control system in the image recording apparatus shown in FIG. 1 will be described. A configuration of the control system is shown in a block diagram in FIG. 5. A CPU 130, ROM 131, RAM 132, a recording head moving drive section 133, a recording medium conveying drive section 134, a recording head recording drive section 135, a data receiving section 136, a waiting time timer section 137 and an interface section 138 are connected via a data bus 141. The CPU 130 controls the whole recording apparatus 144 based on a program stored in the ROM 131. Recording information transmitted from a host computer 140 via a printer driver 139 is received by the data receiving section 136 on a printer side. The data receiving section 136 sends and receives data in accordance with condition of the printer and the received data is stored in the RAM 132. In compliance with a recording command from the host computer 140, the CPU 130 controls the recording head moving drive section 133, the recording medium conveying drive section 134 and the recording head recording drive section 135.

Figure 5:
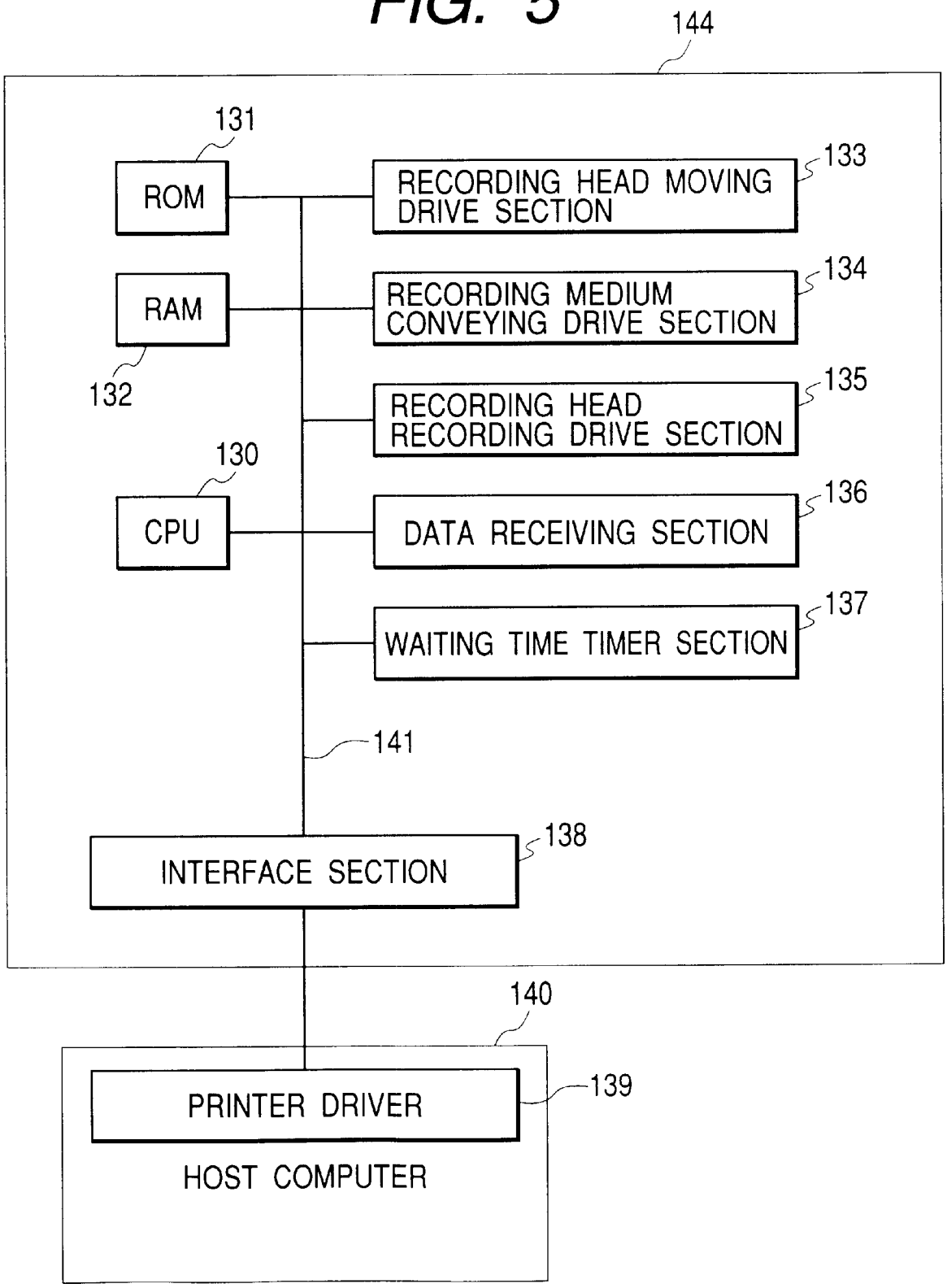
FIG. 5 is a block diagram showing a control system of an image recording apparatus according to a first embodiment of the present invention.

Further detailed description on FIG. 5 will be made. The CPU 130 reads programs or various kinds of data from the ROM 131, the RAM 132, or the like, carries out necessary calculation or determination, and outputs various control signals in compliance with control programs to carry out drive control of the whole apparatus. The ROM 131 is a program memory and stores various programs, various data or the like for the CPU 130 to operate. The RAM 132 is a buffer memory and is configured by a working area where the CPU 130 temporarily stores the data on command or calculation results, a text area where various data is stored, or the like. To the CPU 130, the waiting time timer section 137 which measures time based on an instruction signal from the CPU 130 and outputs time information is connected via the data bus 141.

The CPU 130 is electrically connected to the host computer 140 via the interface section 138, and controls recording operation based on an image data (recording data) from the host computer 140, which is stored in the ROM 131 or RAM 132. The host computer 140 is provided with the printer driver 139 for receiving recording information generated or edited on the computer and passing the information to the recording apparatus 144 side via the interface section 138. The printer driver 139 is provided such as to be able to set or select various information on recording of the recording apparatus 144, and the set or selected information is also passed to the recording apparatus 144 side.

Various information on recording includes setting of a kind of the recording medium such as a sheet for recording, or selecting between a one-side recording mode or both-side recording mode, as an example. The CPU 130 controls the recording head moving drive section 133 and recording medium conveying drive section 134, and also controls the recording section 2 (recording head 21) via a recording head recording drive section 135 based on the recording information stored in the RAM 132. An operation panel for setting recording condition of the recording mode or the like and a sheet sensor for detecting front and rear ends of the recording sheet are connected to the CPU via the data bus.

Figure 6:
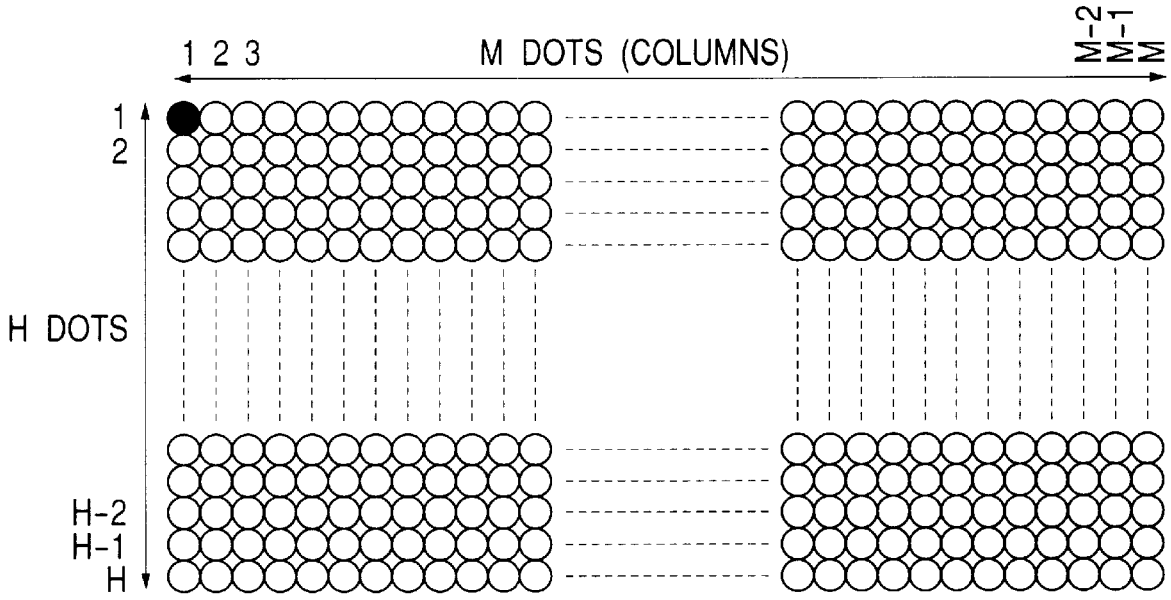
FIG. 6 is an explanatory view of a buffer memory of a recording apparatus.
Figure 7:
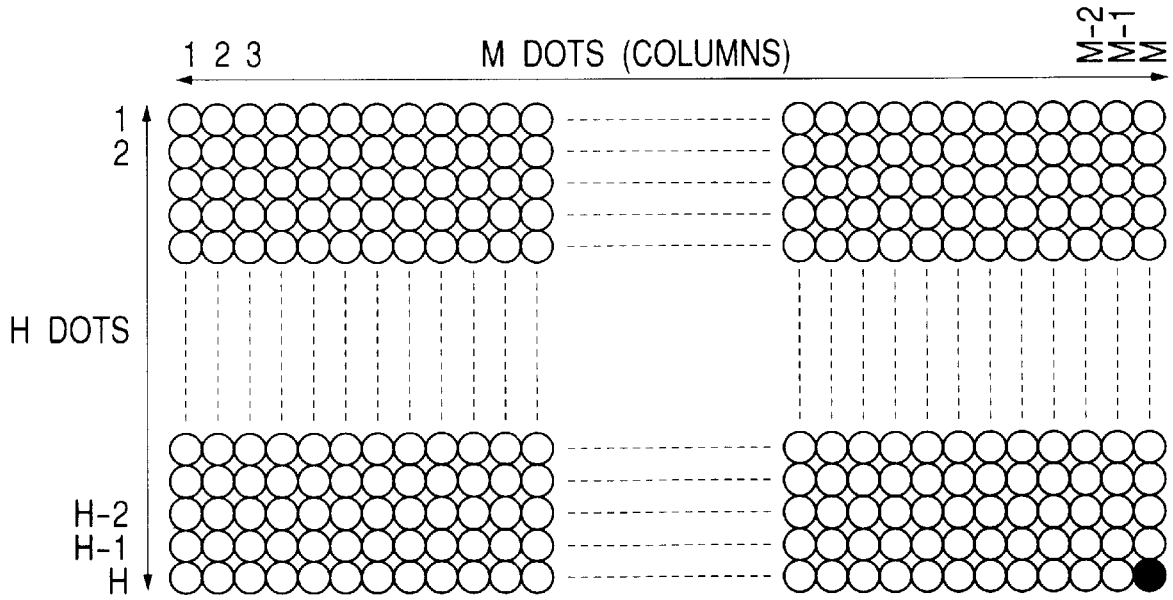
FIG. 7 is another explanatory view of the buffer memory of the recording apparatus.

The RAM 132 as the buffer memory is adapted to store the recording data for one scanning or plural times of scanning. This line buffer is a buffer which stores information regarding the position in the recording area where recording is carried out by the orifice of the recording head in one main scanning of the recording head. FIGS. 6 and 7 show an example of a condition where the recording data is stored in the buffer provided in the RAM 132.

The buffer is configured to have M columns required for expressing the maximum recording width of the recording sheet, which can be used by the recording apparatus 144, with a predetermined dot pitches and lines corresponding to the number of orifices of the recording head. For the recording data transmitted from the host computer and expanded, storing a dot information is started at the first line and first column (the dot filled in with black) of the buffer as shown in FIG. 6 when recording on the surface of the recording sheet, while storing a dot information is started at line H and column M (the dot filled in with black) of the buffer as shown in FIG. 7 when recording on the reverse side. In case of storing the recording data on the reverse side, storing order may be the same as in the case of storing on the surface shown in FIG. 6, and may be configured to reverse order of the image data (recording data) passed from the printer driver 139 to the recording apparatus 144 side as shown in FIG. 5. The dots shown in FIG. 6 are such that the dots expanded and recorded on the recording sheet are typically represented, and a dot is not necessarily dealt with as a piece of recording data.

Next, operation of the inkjet recording apparatus according to this embodiment at the time of the both-side recording mode will be described based on the control system configured as mentioned above. The recording apparatus is configured such that the recording data stored in the line buffer (RAM 132) for recording is subjected to a predetermined processing for both-side recording in the printer driver 139 and then passed via the interface section 138.

Figure 8:
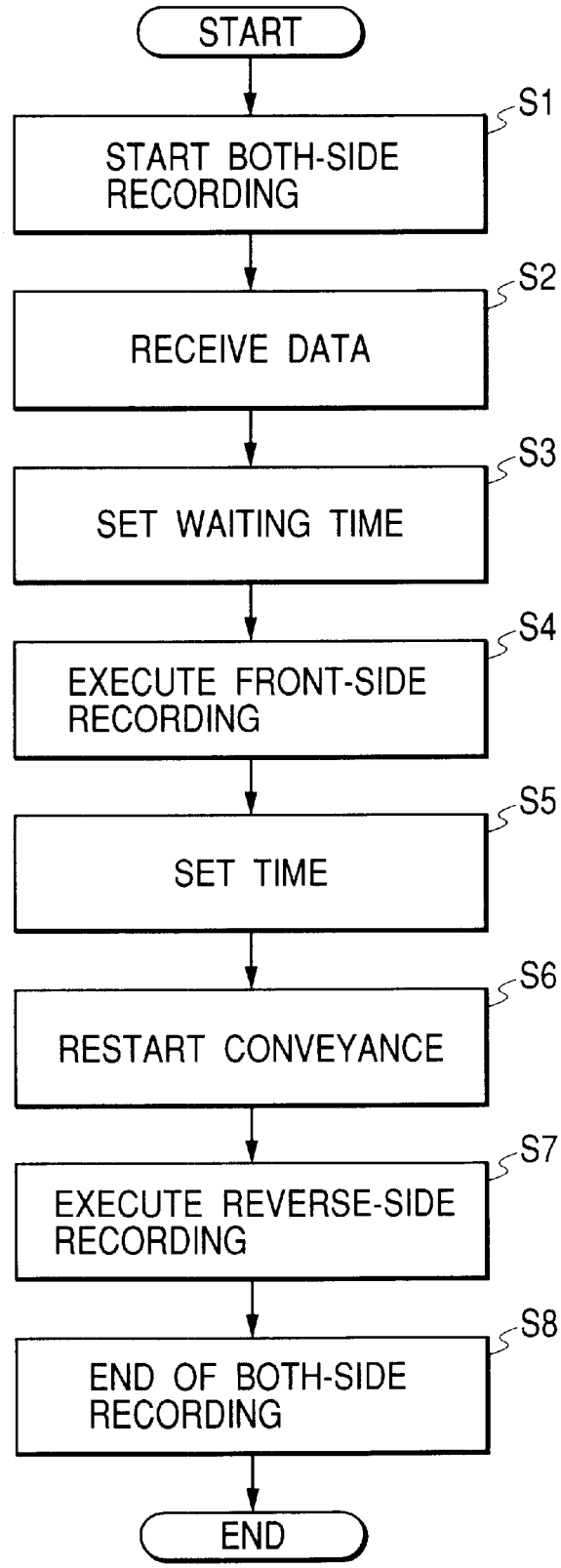
FIG. 8 is a flowchart showing a flow of recording operation at the time of a both-side recording mode.

FIG. 8 is a flowchart showing a flow of recording operation at the time of the both-side recording mode. In a step S1, a command of start of recording is received from the host computer 140. Next, in a step S2, an image data is received from the printer driver 139 of the host computer 140. Then, in a step S3, a length of time (waiting time) between an end of recording on the surface (first recording side) of the recording medium and a start of recording on the reverse side (second recording side) is calculated to be set (determined) based on the received image data. Here, the time is determined in accordance with the image data for recording on the surface (first recording side) of the recording medium. Specifically, an application amount of ink (total amount of applied ink) on the surface is calculated from the image data for recording on the surface, and based on the calculation result, the time between the end of surface recording and the start of reverse side recording is determined. For example, when the application amount of ink is a first amount, a first length of time is set, while when the application amount of ink is a second amount smaller than the first amount, a second length of time shorter than the first length of time is set. That is, the larger application amount of ink causes the longer length of time, while the smaller application amount of ink causes the shorter length of time.

Next, in a step S4, recording on the surface of the recording medium is carried out. Then, in a step S5, a timer is set for the time set in the step S3. Subsequently, in a step S6, conveyance of the recording medium is restarted after having the recording medium wait for a certain time so that the reverse recording is started after passage of the set time. In a step S7, recording on the reverse side of the recording medium is carried out. After the end of recording on the reverse side, the recording medium is output to the paper output tray (paper output section) 3. As described above, both-side recording is ended (a step S8).

In the above description, the application amount of ink (total amount of applied ink) on the surface (first recording side) of recording medium is calculated, and in accordance with the calculation results, the time between the end of recording on the surface (first recording side) of the recording medium and the start of recording on the reverse side (second recording side) is determined. However, the embodiment is not limited to this. For example, the length of time may be determined (set) in accordance with the number of applications of ink on the surface (first recording side) of the recording medium. In this case, when the number of applications of ink is a first number, a first length of time is set, while when the number of applications of ink is a second number smaller than the first number, a second length of time shorter than the first length of time is set. That is, the larger number of applications of ink causes the longer length of time, while the smaller number of applications of ink causes shorter length of time. The length of time may be determined (set) in accordance with a recording duty of recording on the surface (first recording side) of the recording medium. In this case, when the recording duty is a first duty, a first length of time is set, while when the recording duty is a second duty lower than the first recording duty, a second length of time shorter than the first length of time is set. That is, the higher recording duty causes the longer length of time, while the lower recording duty causes the shorter length of time. Here, the recording duty means, for example, a ratio of the number of dots formed in a predetermined area on the recording medium. The length of time may be determined (set) in accordance with an amount of data for applying ink of the image data for recording on the surface (first recording side) of the recording medium. In this case, when the amount of data for applying ink is a first amount, a first length of time is set, while when the amount of data is a second amount smaller than the first amount, a second length of time shorter than the first length of time is set. That is, the larger amount of data for applying ink causes the longer length of time, while the smaller amount of data for applying ink causes the shorter length of time.

As described above, in this embodiment, a time interval between recording on the first recording side (surface) of the recording medium and recording on the second recording side (reverse side) is determined in accordance with the image data. Further, in this embodiment, by variably setting time for having the recording medium wait in the both-side tray 4, the time interval between recording on the first recording side (surface) of the recording medium and recording on the second recording side (reverse side) is set as the determined time interval described above. Specifically, the time for having the recording medium wait in the both-side tray 4 is set so as to correspond to the determined time interval.

A relationship between the length of time (T) between the end of recording on the surface (first recording side) of the recording medium and the start of recording on the reverse side (second recording side) and the application amount of ink (M) may be previously stored in a waiting time determining table, and the time may be determined by reading from the table. For example, a table is prepared, as shown in FIG. 9, where ranges of the application amounts of ink (M): $0 \leqq M < m1$, $m1 \leqq M < m2$, $m2 \leqq M < m3$, $m3 \leqq M$ ($0 < m1 < m2 < m3$) are corresponded with the length of time (T): $T=t1$, $T=t2$, $T=t3$, $T=t4$ ($t1<t2<t3<t4$), and the length of time may be obtained by referring to the table. That is, when the range of the application amount of ink (M) is $0 \leqq M < m1$, the length of time (T) may be set at t1; when the range of the application amount of ink (M) is $m1 \leqq M < m2$, the length of time may be set at t2; when the range of the application amount of ink (M) is $m2 \leqq M < m3$, the length of time may be set at t3; and when the range of the application amount of ink (M) is $m3 \leqq M$, the length of time may be set at t4.

There may be prepared a table which represents a relationship between the length of time and the number of applications of ink, a table which represents a relationship between the length of time and the recording duty, and a table which represents a relationship between the length of time and the amount of data for applying ink, or the like.

The above descriptions have been made with respect to the fact that the length of time (T) between the end of recording on the surface (first recording side) of the recording medium and the start of recording on the reverse side (second recording side) is determined in accordance with the image data. However, the embodiment is not limited to this. In addition to the image data, a kind of the recording medium may be considered as an element of determining the length of time (T). In this case, a relationship among the length of time (T), the application amount of ink (M) and the kind of the recording medium may be previously stored as a waiting time determining table, and the length of time (T) may be determined by reading from the table. An example of the table is shown in FIG. 11. Use of such a table even allows a property of the recording medium to be considered, which permits setting the length of time (T) more suitable to the property of each recording medium. Further, total recording time can be reduced more than the case in the Japanese Patent Laid-Open No. 6-134982 where the length of time (T) is set only in accordance with the kind of the recording media.

In this embodiment, the recording apparatus carries out determining the length of time between the end of surface recording and the start of reverse side recording. However, not limited to this, the printer driver may carry out the determination.

As described above, in this embodiment, the length of time between the end of surface recording and the start of reverse side recording is variably set in accordance with the image data on the surface of the recording medium, so that occurrence of an ink stain can be sufficiently restrained and total recording time in both-side recording can be reduced.

Second Embodiment

Next, a second embodiment will be described. The second embodiment is identical to the first embodiment except for the control operation of the recording medium, thus descriptions on other components will be omitted here. That is, FIG. 8 only is different, and FIGS. 7 and 9 can be applied to this embodiment.

Figure 10:
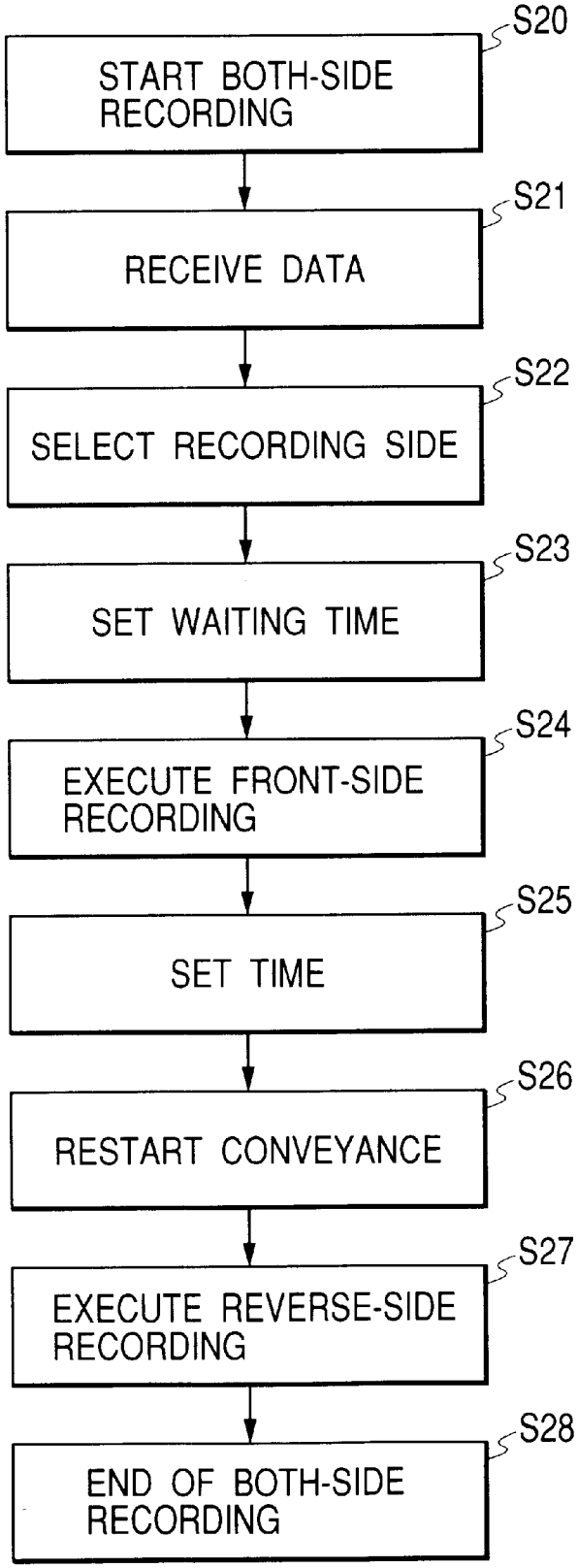
FIG. 10 is a flowchart showing control operation of the recording apparatus.

FIG. 10 is a flowchart showing the control operation of the recording apparatus. In FIG. 10, a command of start of recording from the host computer 140 is received (step S20). Next, when an image data from the host computer 140 is received (step S21), the CPU 130 of the recording apparatus 144 compares the image data on the first recording side with the image data on the second recording side and determines a recording side for previous recording (step S22). Specifically, a side with smaller application amount of ink is determined to be a previous recording side. Here, the first recording side is the previous recording side. Previous recording on the side with the smaller application amount of ink (with lower recording duty) can reduce the length of time between the end of surface recording and the start of reverse side recording.

Next, based on the application amount of ink on the previous recording side (first recording side), the length of time between the end of surface recording and the start of reverse side recording is determined (set) (step S23). Going to a step S24, recording on the previous recording side (first recording side) is carried out. Then, in a step S25, a timer is set for the time set in the step S23. Subsequently, in a step S26, conveyance of the recording medium is restarted after having the recording medium wait for a certain time so that the reverse recording is started after passage of the set time. In a step S27, recording on the reverse side of the recording medium is carried out. After the end of recording on the reverse side, the recording medium is output to the paper output tray (paper output section) 3. As described above, both-side recording is ended (a step S28).

In the above description, the side with the smaller application amount of ink is determined to be the previous recording side. However, not limited to this, for example, a side with the smaller number of applications of ink may be determined to be the previous recording side, a side with a smaller recording duty may be determined to be the previous recording side, or a side with a smaller amount of data for applying ink may be determined to be the previous recording side. As described above, in this embodiment, based on both of the image data for recording on one recording side (first recording side) of the recording medium and the image data for recording on the other recording side (second recording side) of the recording medium, it is determined on which recording side of one recording side (first recording side) or the other recording side (second recording side) of the recording medium, recording is previously carried out.

For a method of determining the length of time between the end of surface recording and the start of reverse side recording, the same method as in the first embodiment can be used.

In this embodiment, the recording apparatus carries out determining the previous recording side of the first and second recording sides and the length of time between the end of surface recording and the start of reverse side recording. However, not limited to this, the printer driver may carry out the determination.

As described above, in this embodiment, recording is started on the side with the lower recording duty of the first and second recording sides and based on the recording data of the previous recording side, the length of time between the end of recording on the previous recording side and the start of recording on the reverse side is determined, so that the time can be reduced and the total recording time in both-side recording can be further reduced.

Third Embodiment

Next, a third embodiment will be described. In the first and second embodiments, the length of time between the end of recording on the first recording side and the start of recording on the second recording side is controlled by variably setting the time for having the recording medium wait in the both-side tray. However, in the third embodiment, the length of time is controlled by variably setting a conveying speed of the recording medium. That is, the length of time is first determined based on the image data on the first recording surface, and when the determined time is relatively long, the conveying speed is set "low", and when the determined time is relatively short, the conveying speed is set "high", thereby controlling the length of time.

Specifically, a table is prepared where ranges of the length of time (T): $0 \leqq T < t1$, $t1 \leqq T < t2$, $t2 \leqq T < t3$, $t3 \leqq T$ ($0 < t1 < t2 < t3$) are corresponded with the conveying speed (V): $V = v1$, $V = v2$, $V = v3$, $V = v4$ ($v1 > v2 > v3 > v4$), and the conveying speed (V) which corresponds to the length of time (T) may be selected. That is, when the range of the length of time (T) is $0 \leqq T < t1$, the conveying speed (V) may be set at v1; when the range of the length of time (T) is $t1 \leqq T < t2$, the conveying speed (V) may be set at v2; when the range of the length of time (T) is $t2 \leqq T < t3$, the conveying speed (V) may be set at v3; and when the range of the length of time (T) is $t3 \leqq T$, the conveying speed (V) may be set at v4. The control of the conveying speed (V) is realized by variably setting a rotational speed of a conveying roller provided in a conveying path.

Other Embodiments

In each of the above embodiments, the length of time between the end of recording on the first recording side and the start of recording on the second recording side is variably controlled by variably setting the time for having the recording medium wait in the both-side tray or by variably setting the conveying speed of the recording medium. However, the present invention is not limited to these methods, and it is essential only that the length of time can be variably controlled. For example, the control may be carried out by having the recording medium wait in the conveying path other than the both-side tray, where the waiting time is variably set, or by providing a plurality of conveying paths in the apparatus to switch the paths for conveyance.

Each embodiment of the present invention is achieved by the fact that a storage medium which stores a program code of software for realizing the function of the embodiment described above is supplied to a system or an apparatus and that a computer (or CPU or MPU) of the system or apparatus reads and executes the program code stored in the storage medium.

In this case, the program code itself read from the storage medium realizes the function of the above described embodiment, so that the storage medium which stores the program code is to constitute the present invention.

The storage medium for supplying the program code includes, for example, a floppy disk, hard disk, optical disk, magneto-optical disk, CD-ROM, CD-R, magnetic tape, non-volatile memory card or ROM.

It is needless to say that executing the program code read by the computer realizes the function of the embodiment, and further that, based on an instruction of the program code, an OS (operation system) which operates on the computer carries out a part or all of actual processing, thereby realizing the function of the embodiment.

Moreover, it is needless to say that the program code read from the storage medium is written in a memory provided in a feature expansion board inserted in the computer or a feature expansion unit connected to the computer, and then that based on the instruction of the program code, the CPU or the like provided in the feature expansion board or feature expansion unit carries out a part or all of actual processing, thereby realizing the function of the embodiment described above.

The above descriptions have been made with respect to the example of using the inkjet recording method as the recording method. However, there is no need to limit the recording method of the present invention to the inkjet recording method, and a thermal transfer recording method, thermal recording method, and further, a recording method such as a wire dot recording method and other recording methods are applicable. Further, there is no need to limit to a serial recording method, and "a line recording method" may be used.

The present invention has excellent effects in a recording apparatus which uses a recording head of an inkjet method for carrying out recording by utilizing thermal energy to form a spattering (or flying) droplet, particularly of the inkjet recording methods.

For the typical configuration and principle thereof, it is preferable to use basic principles disclosed in, for example, U.S. Pat. No. 4,723,129 and U.S. Pat. No. 4,740,796. The method is applicable to both of "an on-demand type" and "a continuous type". Especially in the case of the on-demand type, it is effective because, by applying at least one driving signal, which corresponds to recording information and provides temperature rise more rapid than nucleate boiling, on an electrothermal converting element arranged so as to correspond to a sheet or a liquid path which holds liquid (ink), the electrothermal converting element generates thermal energy, and film boiling occurs on a heat actuating side of a recording head, and consequently, a bubble in the liquid (ink) can be formed which corresponds to the driving signal one to one. By expansion and contraction of the bubble, the liquid (ink) is discharged through a discharge opening to generate at least one droplet. The driving signal in the form of a pulse is more preferable since suitable expansion and contraction of the bubble are immediately carried out, which permits achieving discharge of the liquid (ink) with especially excellent response. A suitable driving signal in the form of the pulse is such as disclosed in U.S. Pat. No. 4,463,359 or U.S. Pat. No. 4,345,262. Adopting a condition disclosed in U.S. Pat. No. 4,313,124 of the invention regarding a rate of temperature rise of the heat actuating side permits further excellent recording.

The present invention includes, as a configuration of the recording head, a configuration of a combination of the discharge port, liquid path and electrothermal converting element (a line liquid path or rectangular liquid path) disclosed in each of the above s, and also includes a configuration using U.S. Pat. No. 4,558,333 and U.S. Pat. No. 4,459,600 each of which discloses a heat actuating portion arranged in a bending area.

Moreover, the present invention is effective in a configuration based on Japanese Patent Laid-Open No. 59-123670 which discloses a configuration such that a plurality of electrothermal converting elements have common slits as discharge portions or Japanese Patent Laid-Open No. 59-138461 which discloses a configuration such that an opening which absorbs a pressure wave of thermal energy is corresponded with a discharge portion. That is, whatever type the recording head is, the present invention can assure efficient recording.

The present invention is effectively applicable to a full-line type recording head having a length corresponding to the maximum width of a recording medium on which a recording apparatus can carry out recording. Such a recording head may includes either of a configuration such that a plurality of recording heads are combined to meet the length or a configuration as a recording head integrally formed.

Further, the present invention is also effective in the serial type recording head as mentioned above, a recording head secured to an apparatus body, a replaceable tip type of recording head which is mounted on an apparatus body to thereby permit electrical connection with the apparatus body or supply of ink from the apparatus body, and a cartridge type of recording head which per se is integrally provided with an ink tank.

As a configuration of the present recording apparatus, adding discharge recovery means, preliminary auxiliary means, or the like of the recording head is preferable since the effect of the present invention can be more stable. Specifically, capping means of the recording head, cleaning means, pressure or suction means, preliminary heating means for heating by means of an electrothermal transducing element or other heating element or a combination thereof, and preliminary discharge means for discharge other than recording can be cited.

For the kinds and number of equipped recording heads, more than two heads may be provided corresponding to a plurality of inks with different recording colors or concentration. That is, for example, the present invention is also highly effective in a recording apparatus having, besides a recording mode of a main color such as black, at least one of a multi color mode with different colors and a full color mode by mixing colors, in which the recording head may be configured as an integral head or as a combination of a plurality of recording heads.

Moreover, in the embodiments of the present invention described above, the ink is liquid. However, ink which is hardened at room temperature and less and which is softened or liquefied at room temperature may be used. Alternatively, ink which is liquefied at the time of applying a use recording signal may be used since in a general inkjet method, temperature of the ink itself is adjusted within a range between 30° C. and 70° C. to control the temperature such that viscosity of the ink falls within a stable discharge range.

Further, ink which is hardened in an left condition and liquefied by heating may be used in order to positively prevent temperature rise due to thermal energy by using the thermal energy as energy for changing condition of the ink from solid to liquid or prevent vaporization of the ink. In any case, the present invention is applicable in the case of using ink, which has a characteristic of being first liquefied by applying the thermal energy, such as ink liquefied by applying the thermal energy in accordance with the recording signal to discharge liquid ink or ink which is started to be hardened at the time of reaching the recording medium. The ink in these cases may be such as to face an electrothermal converting element in a condition of being held as liquid or solid by a recess of a porous sheet or a through hole as disclosed in Japanese Patent Laid-Open No. 54-56847 or Japanese Patent Laid-Open No. 60-71260. In the present invention, the method most effective to each ink described above is the type of carrying out the film boiling.

As described above, according to the present invention, when carrying out both-side recording, occurrence of an ink stain can be restrained and time for printing can be reduced.

What is claimed is:

1. An image recording apparatus for recording an image by applying a coloring material on a recording medium in accordance with image data by recording means, comprising:

conveying means for conveying the recording medium so as to permit recording on both a first recording side and a second recording side of the recording medium;

determining means for determining data which is recorded earlier, based on both image data relating to an amount of ink applied to the first recording side of the recording medium and image data relating to an amount of ink applied to the second recording side of the recording medium;

setting means for variably setting a length of time between an end of recording on the first recording side of the recording medium and a start of recording on the second recording side of the recording medium in accordance with the data determined by said determining means; and control means for controlling a conveying operation by said conveying means such that recording on the second recording side by said recording means is started after passage of time set by said setting means.

2. The image recording apparatus according to claim 1, wherein a recording duty of the recording side which is recorded earlier is lower than a recording duty of the recording side which is not recorded earlier.

3. An image recording method for recording an image by applying a coloring material on a recording medium in accordance with image data by recording means, comprising the steps of:

conveying the recording medium so as to permit recording on both a first recording side and a second recording side of the recording medium;

determining data which is recorded earlier, based on both image data relating to an amount of ink applied to the first recording side of the recording medium and image data relating to an amount of ink applied to the second recording side of the recording medium;

variably setting a length of time between an end of recording on the first recording side of the recording medium and a start of recording on the second recording side of the recording medium in accordance with the data determined in said determining step; and controlling a conveying operation of the recording medium such that recording on the second recording side is started after passage of time set in said setting step.

4. The image recording method according to claim 3, wherein a recording duty of the recording side which is recorded earlier is lower than a recording duty of the recording side which is not recorded earlier.

5. An image recording apparatus for recording an image by applying a coloring material on a recording medium in accordance with image data by recording means, comprising:

conveying means for conveying the recording medium so as to permit recording on both a first recording side and a second recording side of the recording medium;

setting means for variably setting a length of time between an end of recording on the first recording side of the recording medium and a start of recording on the second recording side of the recording medium in accordance with the image data for recording on the first recording side of the recording medium; and control means for controlling a conveying operation by said conveying means such that recording on the second recording side of the recording medium by said recording means is started after passage of time set by said setting means, wherein said control means changes the conveying speed of the recording medium by said conveying means in accordance with the set length of time.

6. An image recording method for recording an image by applying a coloring material on a recording medium in accordance with image data by recording means, comprising the steps of:

conveying the recording medium so as to permit recording on both a first recording side and a second recording side of the recording medium;

variably setting a length of time between an end of recording on the first recording side of the recording medium and a start of recording on the second recording side of the recording medium in accordance with the image data for recording on the first recording side of the recording medium; and controlling a conveying operation of the recording medium such that recording on the second recording side of the recording medium by the recording means is started after passage of time set in said setting step, wherein the conveying speed of the recording medium is changed in accordance with the set length of time set in said controlling step.

* * * * *

UNITED STATES PATENT AND TRADEMARK OFFICE

CERTIFICATE OF CORRECTION

PATENT NO. : 6,652,060 B2
DATED : November 25, 2003
INVENTOR(S) : Uchida

It is certified that error appears in the above-identified patent and that said Letters Patent is hereby corrected as shown below:

Column 1,
Line 67, “made contact” should read -- made to contact --.

Column 7,
Line 12, “other sensor” should read -- other sensors --.

Column 8,
Line 13, “condition” should read -- conditions --; and
Line 27, “with a” should read -- with --.

Column 13,
Line 8, “that based” should read -- based --; and
Line 59, “above s,” should read -- above patents --.

Column 14,
Line 10, “includes” should read -- include --;
Line 36, “multi color” should read -- multicolor --; and
Line 50, “an left” should read -- an unused --.

Signed and Sealed this

Twentieth Day of July, 2004

JON W. DUDAS
*Acting Director of the United States Patent and Trademark Office*